US012508489B2

(12) United States Patent
Masters

(10) Patent No.: US 12,508,489 B2
(45) Date of Patent: Dec. 30, 2025

(54) EXERCISE EQUIPMENT STORAGE AND TRANSPORT

(71) Applicant: Crosspoint International, Inc., West Palm Beach, FL (US)

(72) Inventor: Benjamin L. Masters, West Palm Beach, FL (US)

(73) Assignee: CROSSPOINT INTERNATIONAL, INC., West Palm Beach, FL (US)

( * ) Notice: Subject to any disclaimer, the term of this patent is extended or adjusted under 35 U.S.C. 154(b) by 482 days.

(21) Appl. No.: 18/098,873

(22) Filed: Jan. 19, 2023

(65) Prior Publication Data

US 2024/0245968 A1 Jul. 25, 2024

(51) Int. Cl.
*A63B 71/00* (2006.01)

(52) U.S. Cl.
CPC .... *A63B 71/0036* (2013.01); *A63B 2225/093* (2013.01)

(58) Field of Classification Search
CPC ..... A63B 17/00; A63B 17/04; A63B 21/072; A63B 21/0722; A63B 21/0724; A63B 21/0728; A63B 71/0036; A63B 2071/025; A63B 2210/00; A63B 2210/50; A63B 2225/09; A63B 2225/093; A63B 2225/11; A63B 2244/09
See application file for complete search history.

(56) References Cited

U.S. PATENT DOCUMENTS

| | | | | |
|---|---|---|---|---|
| 4,477,074 | A * | 10/1984 | Bushnell | A63B 21/078 482/106 |
| 10,398,927 | B2 * | 9/2019 | Baumler | A63B 21/0004 |
| 10,456,655 | B1 * | 10/2019 | Orehek | B62B 5/06 |
| 10,874,897 | B1 * | 12/2020 | Eastham, Jr. | A63B 22/20 |
| 11,167,197 | B2 * | 11/2021 | Kleva | A63B 21/0724 |
| 11,179,591 | B1 * | 11/2021 | Bazargan | A63B 69/34 |
| 11,724,150 | B2 * | 8/2023 | Bazargan | A63B 21/0051 482/8 |
| 11,833,408 | B2 * | 12/2023 | Chen | A63B 21/00065 |
| 2015/0104279 | A1 * | 4/2015 | Kenton | E04G 21/3261 414/812 |
| 2018/0243597 | A1 * | 8/2018 | Schlegel | A63B 23/047 |

(Continued)

FOREIGN PATENT DOCUMENTS

| | | | | |
|---|---|---|---|---|
| GB | 2610609 A | * | 3/2023 | A63B 71/0036 |
| KR | 20230000308 U | * | 2/2023 | A63B 21/0605 |
| TW | M622434 U | * | 1/2022 | |

*Primary Examiner* — Gary D Urbiel Goldner
(74) *Attorney, Agent, or Firm* — Rod D. Baker

(57) ABSTRACT

An apparatus and system for storing and transporting exercise equipment, particularly weightlifting equipment including barbells and weight plates, dumbbells, and kettlebells. The system provides for rolled transport, and facile compact storage, of the weightlifting equipment. An embodiment of the system includes a front frame and a rear frame. Means are provided for pivotally connecting a front joining section to a rear joining section. A first axle may be inserted through front axle holes in the front frame and a second axle may be inserted through rear axle holes in the rear frame. When the first axle is inserted through the front axle holes, and when the second axle is inserted through the rear axle holes, a barbell weight plate may be disposed on each end of each axle to serve as a wheel upon which the frames may be rolled.

19 Claims, 10 Drawing Sheets

(56) References Cited

U.S. PATENT DOCUMENTS

| | | | | |
|---|---|---|---|---|
| 2018/0296873 | A1* | 10/2018 | Amyan | A63B 21/0722 |
| 2018/0311522 | A1* | 11/2018 | Schmidt | A63B 21/4009 |
| 2019/0269957 | A1* | 9/2019 | Petrucci | A63B 21/4039 |

* cited by examiner

EXERCISE EQUIPMENT STORAGE AND TRANSPORT

BACKGROUND OF THE INVENTION

Technical Field

The present invention relates generally to the field of exercise equipment, particularly to weightlifting devices, and specifically to a system and apparatus for storing and moving exercise equipment including weightlifting devices.

Description of Background Art

Exercise equipment of many kinds and functions have long been known. An increasingly popular type of exercise devices are weightlifting systems and sets. The lifting of weights can promote both aerobics and muscle strength. Besides their placement in high schools, universities, and various kinds of commercial exercise facilities and gyms, weightlifting systems and sets also are found in private homes. Barbell weights are components of weightlifting equipment. So are dumbbells and kettlebells.

A barbell is a known kind of exercise equipment used in weight training, bodybuilding, weightlifting, and powerlifting, and normally consists of a long bar; in use, a barbell typically has weights attached at each end. A barbell has three main components: the bar or "shaft" of the barbell, the two sleeves—one on each end—and the bearings or bushings that connect the sleeves to the bar. The sleeves are slid onto each side of the bar. The bushings or bearings hold the sleeve on the bar; they also allow the sleeve to rotate and move independently of the shaft without falling off. The weights are placed near the distal ends of the sleeves.

Bearings are found in bars designed for Olympic lifting and are generally made of ball bearings, thrust bearings, or needle bearings. The bar extends all the way into the sleeves, and the sleeves are rotatable on the bar. The sleeves accordingly are the elements on the outer portions of the bar that hold the weight plates. On standard Olympic barbells the sleeves are 5 centimeters in diameter. This is important because nearly all weight plates are made to fit a standard bar.

Ordinary barbells in common use range in length from 1.2 meters to 2.2 meters. The central portion of the bar varies in diameter from 25 millimeters to 50 millimeters. This central segment often is engraved with a knurled crosshatch pattern to promote a solid grip by the weightlifting user. Various "weight plates" slide onto the outer portions of the bar to increase or decrease the desired total weight. Collars are releasably but securely attachable at appropriate locations on the barbell to prevent weight plates from moving unevenly, or from sliding off the barbell. A variety of exercises can be performed using the barbell, such as bicep curl, bench press, Olympic weightlifting, overhead press, deadlift, and squat. A standard Olympic barbell usually weighs about 20 kilograms.

More specifically, a men's Olympic bar is a metal bar that is 2.2 meters long and weighs 20 kilograms. The outer sleeves of a men's barbell are usually 50 mm in diameter, while the central, inner grip section or "shaft" is typically about 28 millimeters in diameter, and the center segment of the center bar (in between the two sleeves) is 1.31 meters in length. The sleeve diameter is important when building a weightlifting set, because nearly all weight plates have a central hole that fits a standard bar. These are the standards applied in competitive weightlifting where men and women compete at the highest level (e.g., the Commonwealth Games, Pan-American Games, World Championships, and the Olympics). Bars of this kind are required to have appropriate "whip," that is, ability to flex to store elastic energy, and sleeves which rotate smoothly, as well as the capacity to withstand dropped lifts from overhead. A normal women's Olympic bar is similar to the men's bar, but is shorter (2.01 meters) and lighter (15 kilograms) with a relatively reduced grip section diameter of 25 millimeters.

In most lifts of a barbell, weight plates are disposed near each end of the bar, on the sleeves. The weight plates used in Olympic lifting, frequently called "bumper plates," must be able to be safely dropped from above head height, and consequently are coated in shock-absorbing rubber. General strength training or powerlifting plates are typically made from cast iron. Weight plates used in Olympic lifting, frequently called "bumper," plates, may also be cast iron, but are coated in solid rubber to make them safe to drop from above head height Weight plates are commonly found in the following weights: 0.5 kg, 1.0 kg, 1.5 kg, 2.0 kg, 2.5 kg, 5.0 kg, 10 kg, 15 kg, 20 kg, and 25 kg. Various combinations of incremental weights of plates may be employed during a lift by a user, but the total weight lifted is to be safely divided equally and balanced on the ends of the barbell. Weight plates are commonly disk-shaped, with a central aperture through which the barbell is disposed during use. Olympic plates of 10 kilograms or more are about 450 millimeters in diameter. Lighter 5.0 kg and 2.5 kilograms versions of plates having 450 millimeter diameters also exist to accommodate the proper starting position for beginner athletes.

Many Olympic bars commonly encountered in commercial gyms and private homes, although superficially similar to standard Olympic bars, sometimes do not share International Weightlifting Federation (IWF) or powerlifting characteristics. They are simply generic strength training bars, with wide variations in markings, grip section diameter, and exact weight. Weight plates used outside of formal competition need not conform to IWF or powerlifting specifications. Standard collars for temporarily fixing the positions of the weight plates may be of any material, usually metal but also often plastic, and may weigh up to about 2.5 kilograms (normally less) each for both men and women's bars. Thus, a typical Olympic bar with a pair of collars, the plates not counted, can weigh as much as 25 kilograms for men and 20 kilograms for women depending on the collars. The barbell thus is a longer version of the "dumbbell" that is used for free weight training and in competitive sports.

Dumbbells are known in the art as weights used without exercise machines. Dumbbells are sometimes also called "free weights"—those used "free" of other equipment. Most dumbbells are designed with a narrow bar in the middle and two wider discs at each end. Some dumbbells are light in weight (only a kilogram or two) while others are relatively heavy (15 kg or more). Also, dumbbells can be fixed or variable in weight. Adjustable dumbbells can vary in weight due through the use of discs that can be added or removed from the bar by quantity and size (weight). Further, dumbbells can be used individually (a dumbbell in one hand) or in pairs (one in each hand). The purpose of dumbbells is to strengthen the body and to tone the muscles.

A kettlebell is a known type of free weight that is round with a flat base and an arch-like handle. A kettlebell looks somewhat like a cannonball with a handle, or a teapot without the spout (hence the name "kettlebell" in English). Kettlebells are usually made of either cast iron or steel. Unlike a dumbbell, a kettlebell's center of mass extends beyond the hand. Kettlebells can be swung, thrown, pressed, held, moved and manipulated in countless ways. They are small and portable, and may be incorporated into a variety of fitness training programs.

The storage and transportation of extensive (and expensive) sets or collections of weightlifting exercise equipment, including those discussed above, can pose a challenge. Moving a complete set or collection of weightlifting tools can be difficult due not only to the number of items to be moved, but also because of the total weight involved. If it is desired to store weightlifting equipment in one place, but to use it in another, transportation can discourage the use of the equipment. And it is normally desirable to store all the equipment in an organized manner, preferably in a comparatively small storage area.

Against the foregoing background, the presently disclosed exercise equipment storage and transportation system was developed.

SUMMARY OF THE DISCLOSURE

There is disclosed an apparatus and system for storing and transporting exercise equipment, particularly weightlifting equipment including barbells and weight plates, dumbbells, and kettlebells. The system is not so limited, as other kinds of exercise equipment may be disposed on the system. An object of the present invention is to provide a system that provides for rolled transport, and facile compact storage, of weightlifting equipment. An advantage of the present invention is that it is simple, and affordably manufactured. Another advantage of the present invention is that weight plates are used in the system as wheels for rolling transport of the system.

There is disclosed an exercise equipment storage and transport system for receiving barbells and weight plates. An embodiment of the system includes a front frame with two parallel horizontal front arms, each penetrated laterally by at least one front axle hole, and a front joining section that joins the front arms. This basic embodiment also has a rear frame with two parallel horizontal rear arms, each penetrated laterally by at least one rear axle hole, and a rear joining section that joins the rear arms. Means are provided for connecting the front joining section to the rear joining section. A first axle may be inserted through the front axle holes and a second axle may be inserted through the rear axle holes; when the first axle is inserted through the front axle holes, and when the second axle is inserted through the rear axle holes, at least one weight plate is disposed on each end of each axle to serve as a wheel upon which the frames may be rolled.

An extended embodiment of the system includes comprising the front frame and the rear frame, as well as an intermediate frame operatively situated between the front and rear frames. The intermediate frame has two parallel horizontal intermediate arms, each penetrated by at least one intermediate axle hole, an anterior joining section that joins the intermediate arms, and a posterior joining section that joins the intermediate arms. Means are provided for connecting the front joining section to the anterior joining section, and there also are means for connecting the rear joining section to the posterior joining section. A first axle may be inserted through the front axle holes and a second axle may be inserted through the rear axle holes. When the first axle is inserted through the front axle holes, and when the second axle is inserted through the rear axle holes, at least one weight plate is disposed on each end of each axle to serve as a wheel upon which the frames may be rolled.

Dumbbell and kettlebell carriers are removably mountable upon one or all the frames, whereby dumbbell and kettlebell sets can be transported by the rolling system, and stored in an orderly and compact manner thereon. In a basic embodiment of the system, a barbell may also be stored and transported on the system; an alternative extended embodiment permits one or two barbells to be stored and transported. Barbell weight plates are stored on the system as wheels, or on plate carrier rods mounted on the intermediate frame.

Other objects and advantages of the system, apparatus, and method of the present invention shall be apparent from the following specification.

BRIEF DESCRIPTION OF DRAWINGS

Illustrative embodiments that incorporate one or more features according to the invention are described with reference to the following drawings. The drawings are not necessarily to scale, and scale may vary between figures. Like numerals are used among the several views to label like elements and components. The drawings illustrate, but do not strictly delimit, embodiments of the invention. In the drawings.

Like elements are labelled with like numerals in the several views. The drawings are not necessarily to scale, either between views or within a single view.

DETAILED DESCRIPTION OF A PREFERRED EMBODIMENT

Figures 1A, 1B:
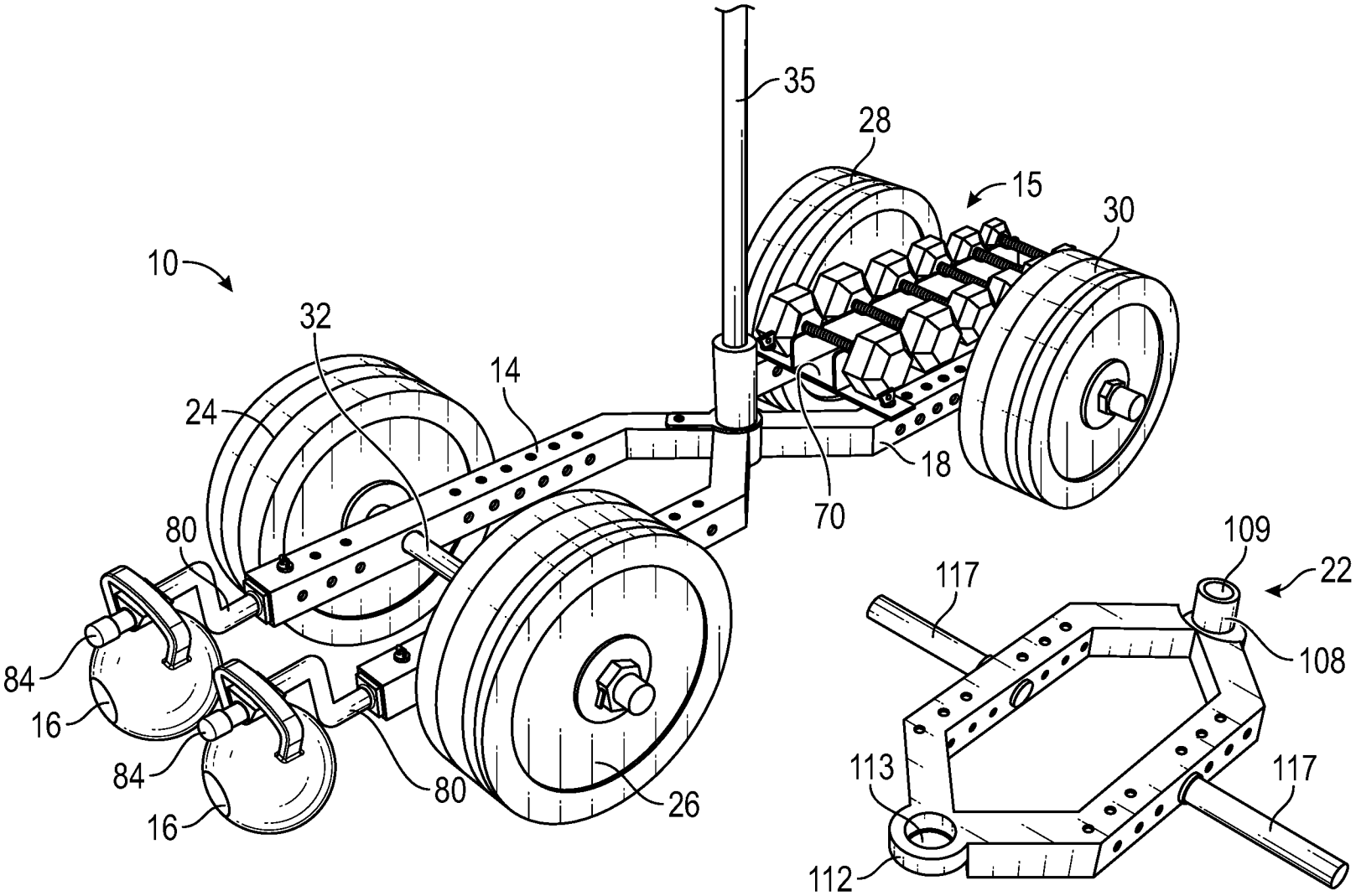
FIG. 1A is a perspective view of the assembled system according to the present invention, shown with two kettlebells, a vertical barbell, and six dumbbells thereon, and weight plates as wheels.
FIG. 1B is a perspective view of an intermediate frame that optionally can be incorporated into the system seen in FIG. 1A.

In the following detailed description, a preferred embodiment is described in sufficient detail so as to enable one skilled in the art to practice the invention. It is understood that other embodiments may be devised, and that logical, mechanical, material and various other assemblies may be made without departing from the scope of the present invention. The following description, therefore, is to disclose the invention but not necessarily to limit its scope.

Thus, while this invention is susceptible of embodiment in many different forms, there is shown in the drawings and will be described in detail, specific embodiments with the understanding that the present disclosure is to be considered as an exemplification of the principles of the invention and is not intended to limit the invention to the embodiments illustrated.

It also should be understood that like or analogous elements and/or components, referred to herein, are identified throughout the drawings by like reference characters. In addition, it should be understood that the drawings are primarily symbolic and are only meant to aid in understanding the ideas and concepts disclosed. In the following disclosure and claims, "up," "upward," "down," and "downward," are used in conventional manners. "Up" and "down" and similar directional words thus can be presumed to be in relation to the direction of gravity. "Inward" and "outward" refer normally to radial directions toward or away from a central axis. "Horizontal" means parallel to the ground or floor, thus ordinarily perpendicular to the gravity vector.

There is disclosed herein an apparatus and system for storing and transporting exercise equipment, particularly a collection of weightlifting items or tools. The system is specially devised to store and transport barbells, dumbbells, and kettlebells, but is not so limited. The system may find utility in storing and moving other kinds of equipment as well. An advantage of the system is its versatility, as the number and kinds of weights that can be stored and transported is flexible and adjustable. Moreover, as described herein, a pair of axles and associated disk-shaped weight plates are readily incorporated into the system to function as a means upon which the system can be rolled. Specifically, two rigid rod-like axles can be engaged in the system, with associated weight plates rotatably disposed as wheels on the axles, so that the overall system can be transported by wheeling it across a supporting surface such the ground or floor.

Figure 3:
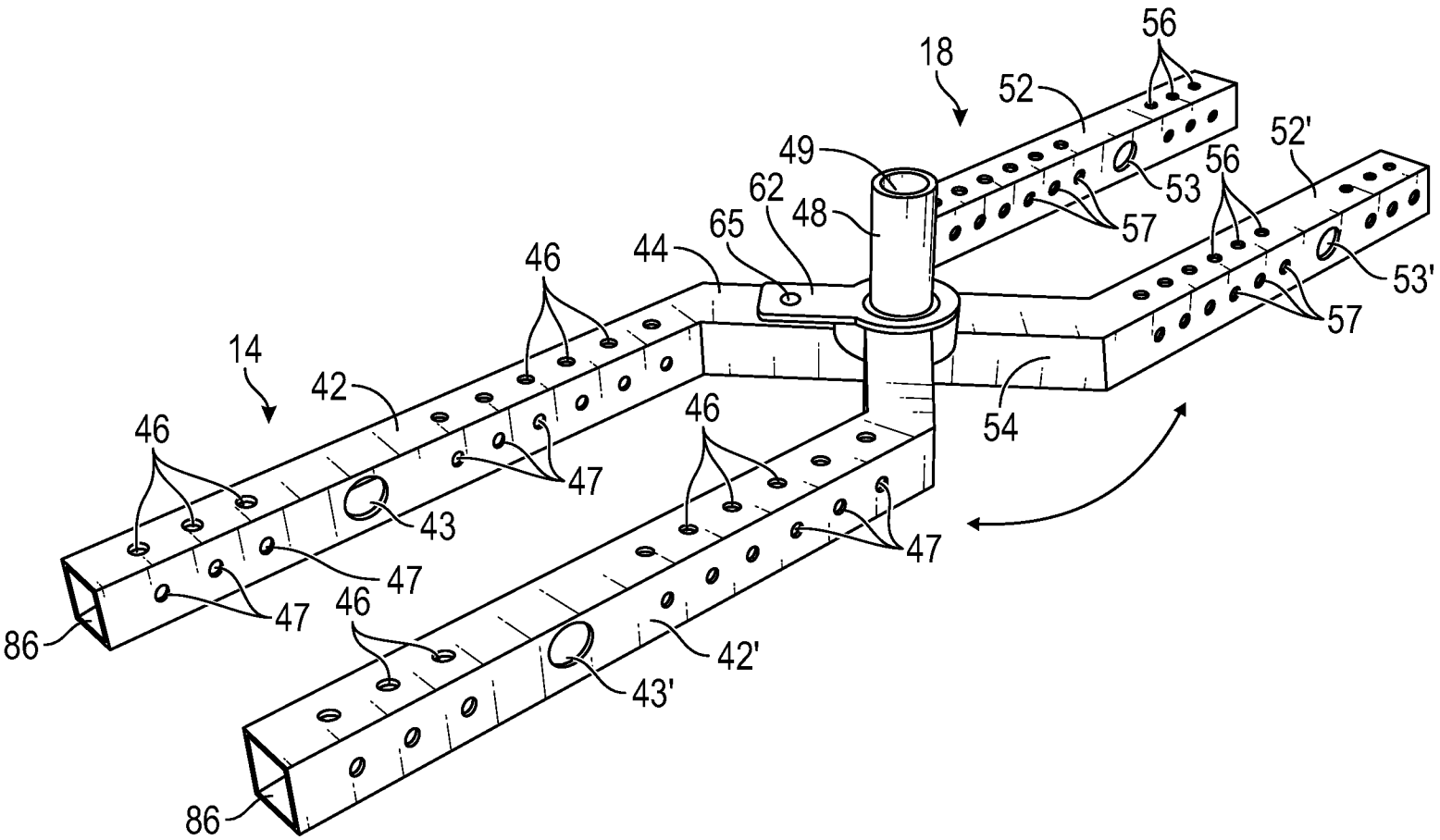
FIG. 3 is a perspective view of a front frame and a rear frame, pivotally connected, according to a basic embodiment of a system according to the invention.

FIG. 1A offers a perspective view of an overall apparatus and system 10 according to the present invention. The basic embodiment of the system 10 is founded upon a fundamental frame assembly having a pair of frame members, a front frame 14 and a rear frame 18. The combination of the front frame 14 and rear frame 18 as connected for use is shown in FIG. 3. Seen in FIG. 1B is an intermediate frame 22 that optionally may be used to assemble an alternative, extended, frame assembly that includes three frame members, with the intermediate frame 22 connected between the front frame 14 and the rear frame 18 as illustrated simply in FIG. 10. FIG. 1A shows generally that a plurality of round disk weight plates 24, 26, 28, 30 are deployed as rolling wheels for the system 10. The weight plates 24, 26, 28, 30 are rotatably mounted upon and on the outsides of the front frame 14 and the rear frame 18. In the preferred embodiment, a rod-like first axle 32 functions as a front axle for the wheels of the front weight plates 24, 26 while a second axle 34 serves as the axle for the wheels of the rear weight plates 28, 30. Axles 32 and 34 are provided as elements of the system 10, and preferably are fabricated from a durable, stiff metal alloy, for example steel. Referring still to FIG. 1A, it is seen that the basic system 10 is assembled for use to store or transport various items of weightlifting equipment. Shown, by way of example, are six dumbbells 15 and a pair of kettlebells 16 removable placed upon the rear frame 18 and the front frame 14, respectively, in a manner further to be described. Also seen in FIG. 1A is a barbell 35 stored vertically at the point where the front and rear frames 14, 18 connect, also in a manner that is explained further herein. The system 10 according to FIG. 1A can be rolled across a supporting surface, typically a floor, to transport the various barbells, weight plates, dumbbells, and kettlebells—and other items a user may elect to place thereon—to and from a storage location.

Figure 2:
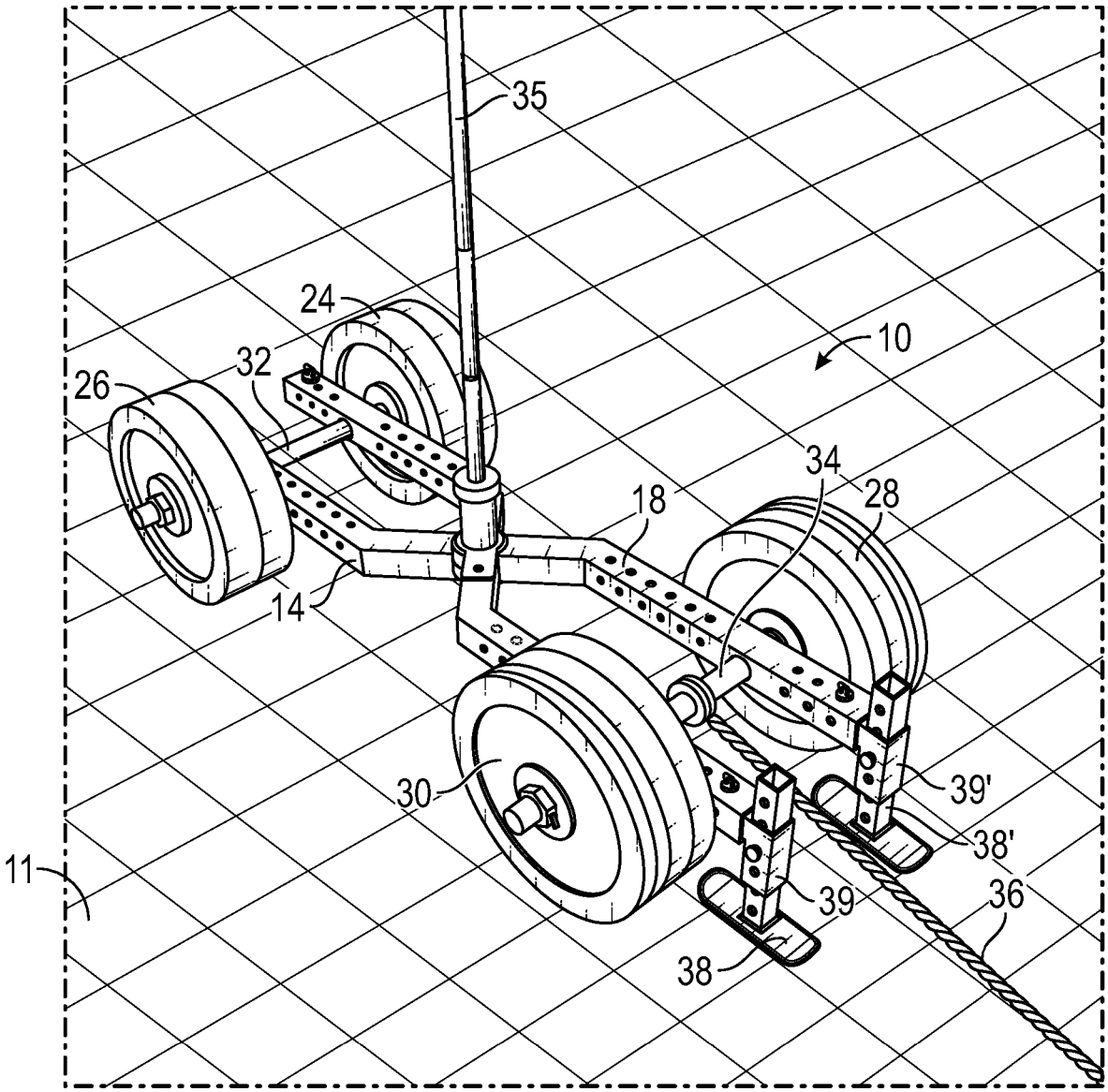
FIG. 2 is another perspective view of a basic embedment of a system according to the invention, showing optional skid sleds and a tether for pulling the system across a supporting surface.

FIG. 2 is another perspective view of the basic system 10 with certain equipment-holding components removed for clarity. The system 10 optionally may include a flexible pulling tether 36 removably connected to either of the front first axle 32 or the rear second axle 34; in FIG. 2 the tether is depicted temporarily connected to the second axle 34. Although not shown in the drawing, it is obvious that the tether 36 alternatively may be connected to the system at other places, such as by a harnessed connection to one of the frames 14 or 18. The temporary connection may be by any suitable means, such as by clamping, tying, a tether collar that can be controllably opened/closed, or other means suited for temporarily connecting a flexible tether to an axle 32, 34, or one of the frames 14, 18. The pulling tether 36 may be a rope, cable, cord, lightweight chain, or other flexible line. The unconnected free end of the tether 36 optionally may be provided with a gripping handle (not shown) to facilitate a user's grasp of the tether. A user may pull manually upon the distal free end of the tether 36 to roll the system 10 across a supporting surface 11 such as a floor or an outdoor ground or concrete pad, or the like. Of course, rolling movement may be imparted to the system 10 by simply pushing directly upon one of the frames and/or the barbell 35 temporarily mounted vertically as seen in FIG. 2.

Also seen in FIG. 2 are sled assemblies comprising a pair of sleds 38, 38' and their associated sled brackets 39, 39', removably attached to the end of the rear frame 18. A pair of such sleds 38, 38' can be employed in lieu of a pair of weight plate wheels, for example rear weight plates 28, 30. For example, if the rear weight plates 28, 30 are removed from the rear frame 18 seen in FIG. 2, the rear frame could be support by, and slid upon the supporting surface 11, by the alternative means of the sleds 38, 38' attached on the rear frame 18 by the brackets 39, 39'. The use of sleds 38, 38' shall be disclosed in further detail hereinafter.

Figure 5A:
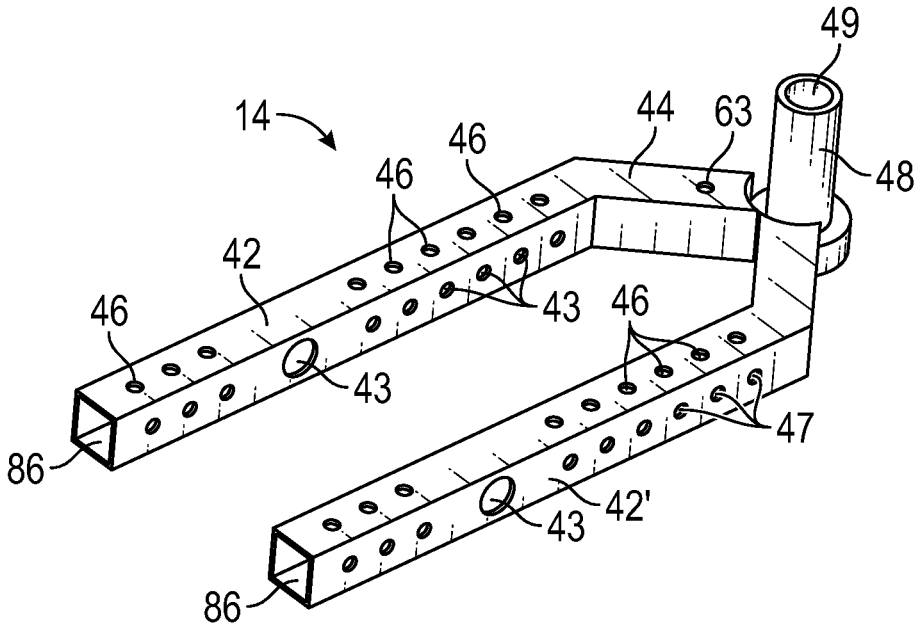
FIG. 5A is a perspective view of the front frame component useable in the system according to the present invention.
Figure 5B:
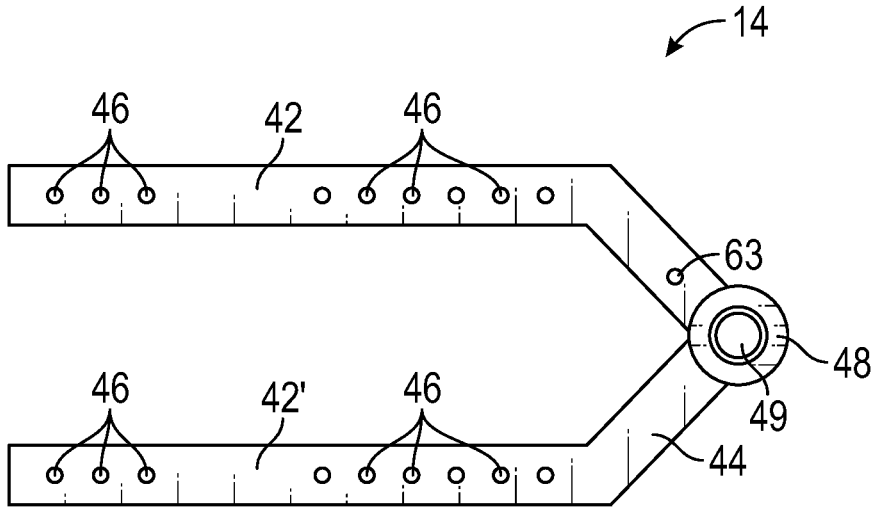
FIG. 5B is a top view of the front frame seen in FIG. 5A.

Attention is advanced to FIGS. 5A and 5B, which detail the configuration of the front frame 14. The front frame 14 preferably is composed from a suitable strong, rigid material, such as a steel or aluminum alloy. The front frame 14 preferably is fabricated, as by welding or other permanent joinder means or method, so that its front arms 42, 42' and front joining section 44 are permanently combined as a single, somewhat Y-shaped, "monobloc" in the sense of unitary or integral, rather than being temporarily assembled from separable elements. Preferably, the front frame 14 is fabricated from square metallic tubular box girders (e.g., for example about 10 cm each side in cross section). The front frame 14 preferably features two parallel horizontal front arms 42, 42', each penetrated laterally by at least one front axle hole 43, 43'. The front frame 14 also includes a front joining section 44 that joins the front arms 42, 42'. As seen in FIGS. 5A and 5B, the front arms 42, 42' have a plurality of top attachment apertures 46 defined serially along each of front arms 42, 42' and vertically penetrating each front arm. Similarly, the front arms 42, 42' also have a plurality of side attachment apertures 47 defined serially along each of the front arms 42, 42' and laterally penetrating the sides of each front arm. Also seen in FIGS. 5A and 5B is a first connector shaft 48 extending vertically upward from the front joining section 44. The first connector shaft 48 preferably is a tube defining a cylindrical hollow interior 49 with a closed bottom (i.e., the top of the connector shaft interior 49 is open, but the interior is closed at or near the junction of the shaft with the front joining section 44). The first connector shaft 48 is secured to or integral with the front joining section 44. The functions of the first connector shaft 48 will be described hereinafter.

Figure 6A:
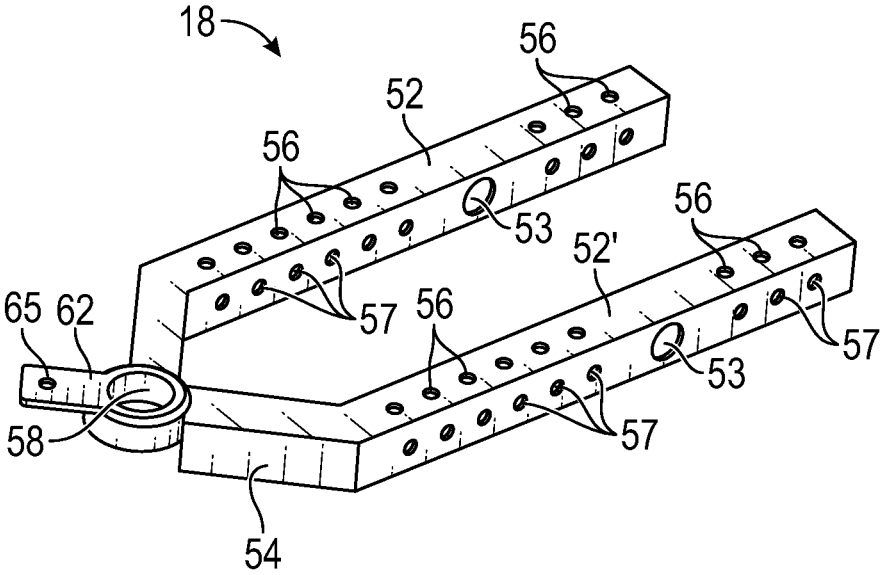
FIG. 6A is a perspective view of the rear frame component useable in the system according to the present invention.
Figure 6B:
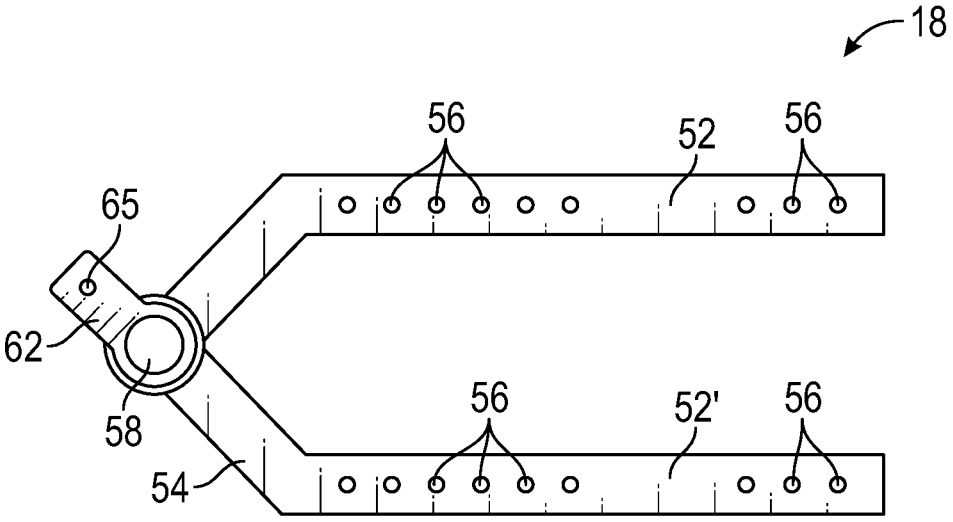
FIG. 6B is a top view of the rear frame seen in FIG. 6A.

FIGS. 6A-6B show the configuration of the rear frame 18. Like the front frame, the rear frame 18 preferably is composed from a suitable strong, rigid material, normally a metal alloy. The rear frame 18 preferably is fabricated so that its rear arms 52, 52' and rear joining section 54 also are combined as a single "monobloc." Preferably, the rear frame 18 like the front frame 14 is fabricated from square tubular box girders. The rear frame 18 preferably features two parallel horizontal rear arms 52, 52', each penetrated laterally by at least one rear axle hole 53, 53'. The rear frame 18 also includes its rear joining section 54 that joins the front arms 52, 52'. As seen in FIGS. 6A and 6B, the rear arms 52, 52' have a plurality of top attachment apertures 56 defined serially along each of rear arms 52, 52' and vertically penetrating each rear arm. Like the front arms, the rear arms 52, 52' also have a plurality of side attachment apertures 57 defined serially along each of the rear arms 52, 52' and laterally penetrating the sides of each rear arm. Also seen in FIGS. 6A and 6B is a rear connector aperture 58 extending vertically through the rear joining section 54. The rear connector aperture 58 preferably is a tube defining a cylindrical hollow interior 59, and is secured to or integrally defined through the rear joining section 54. The functions of the rear connector aperture 58 will be further described.

FIG. 3 illustrates further the assembly and configuration of the fundamental frames of the system 10. The basic frame assembly includes the front frame 14 which in turn has the parallel horizontal front arms 42, 42' penetrated laterally by at least one front axle hole 43, 43'. The front joining section 44 joins the front arms and holds them in spaced relation. The rear frame 18 has the parallel horizontal rear arms 52, 52', each penetrated laterally by at least one rear axle hole 53' 53'. The rear joining section 54 joins the rear arms 52, 52'. FIG. 3 also illustrates that the first connector shaft 48 and the rear connector aperture 58 are operative engageable to serve as a means for connecting the front joining section 44 to the rear joining section 54. As the first connector shaft 48 extends vertically upward from the front joining section 44, and the rear connector aperture 58 is defined vertically through the rear joining section 54, the first connector shaft is disposable upward through the rear connector aperture, thereby to pivotally connect the front frame 14 to the rear frame 18. The outside diameter of the first connector shaft 48 preferably is just less than the diameter of the rear connector aperture 58 so that that the shaft 48 slides through the aperture 58 with little gap between them. When thus interconnected, the two frames 14, 18 are yoked together, yet pivotal relative to one another in the horizontal plane as suggested by the directional arrows in FIG. 3. There is provided, however, a locking flange 62 extending securely from the rear joining section 54 adjacent the rear connector aperture 58 (see also FIGS. 6A-B), which in combination with a locking hole 63 (FIGS. 5A-B) in the front joining section 44, permits the two frames 14, 18 to be selectively and temporarily locked against relative pivotal movement.

Figure 4:
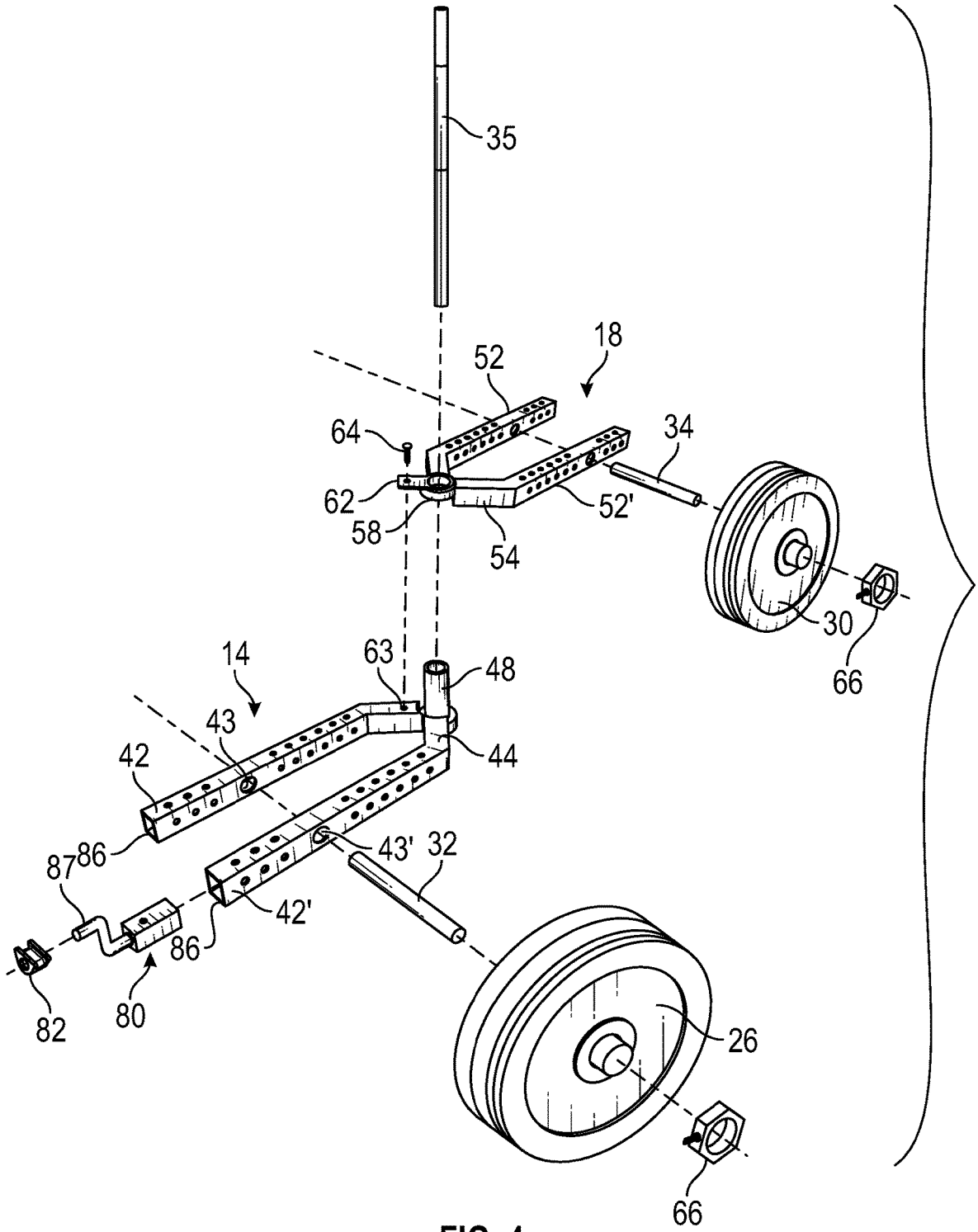
FIG. 4 is an exploded perspective view of the embodiment seen in FIG. 1.

Attention is invited to FIGS. 3 and 4 in combination, showing an assembly of the basic embodiment of the system 10. The use of rod-like axles and disk weight plates as the axles and wheels for a rollably movable system are illustrated. As illustrated in FIG. 4, the first axle 32 is slidably inserted through the front axle holes 43, 43' and the second axle 34 is insertable through the rear axle holes 53, 53. While four axle holes 43, 43' and 53, 53' are illustrated, it is to be understood that more than four axles holes may be defined through the arms of the frames 14 and 18; the number of axle holes in any pair of arms 42, 42' or 52, 52' may be increased to improve the versatility or adaptability of the system 10. The two illustrated front axle holes 43 and 43' are aligned laterally, so that when inserted the first axle 32 is generally perpendicular to both the front arms 42, 42'. Similarly, the rear axle holes 53, 53' are aligned laterally, so that when inserted the second axle 34 is generally perpendicular to the rear arms 52, 52'.

As seen also in FIGS. 1-2, at least one weight plate is disposed on each end of each axle 32, 34 to serve as a wheel upon which the frames 14, 18 (and thus the system 10) may be rolled. For simplicity of illustration FIG. 4 shows only several left front weight plates 24 and the several left rear weight plates 30, while full complements of weight plates 24, 26, 28 and 30 are seen in FIGS. 1 and 2. The number of weight plates disposed near the end of each axle is at least one, but can be more. The plates disposed at an end of a particular axle also can be of differing diameters (in which instance the weight plate of greatest diameter functions effectively as the wheel). Thus, a significant number (e.g., 4-16) weight plates 24, 26, 28 and 30 may be transported and stored upon the axles 32, 34 according to the invention. Preferably, of course, the number, types, and arrangement of weight plates is symmetrical upon the ends of a given axle.

FIG. 4 also shows that conventional barbell collars 66 (e.g., lever-locking barbell collars) potentially may be used to secure the weight plates 24, 26, 28 and 30 at the ends of the axles 32, 34, on the outsides of the respective arms 42, 42', 52, 52' of respective frames 14, 18. Alternative equivalent types of removable collars, not barbell collars, may suitably be devised and provided for the security of the weight plates upon the ends of the axles. Collars 66 may be removably secured to the axles 32, 34, by spring bar clips, or screw-type pins, or the like, according to convention. Consequently, as assembled according to FIGS. 1-2 and 4, two axles 32, 34 and at least four weight plates 24, 26, 28 and 30 can not only be stored in the system 10, but also may serve as the means by which the overall system may be transported by being rolled across the supporting surface 11.

As seen in FIGS. 1-4, a beneficial feature of the system 10 is that a barbell 35 may be stored and moved in the system 10. The barbell 35 optionally may be vertically stored and transported in the system by being slidably and removably inserted into the hollow interior 49 of the front connector shaft 48. The hollow interior 49 defines a diameter that is modestly greater than the standard diameter of an end of a conventional barbell. Thus in a preferred embodiment of the system 10, the first connector shaft 48 is a hollow tube adapted to receive an end of any barbell such as barbell 35.

The barbell 35 is simply dropped into the first connector shaft 48 until the bottom end of the barbell 35 contacts the closed bottom of the shaft interior 49. The third barbell so stored may readily be withdrawn from the shaft 48 for use.

Combined reference to FIGS. 3, 4, 5A-B and 6A-B further illustrates how the first connector shaft 48 and the rear connector aperture 58 serve as the means for connecting the front joining section 44 to the rear joining section 54. Because the first connector shaft 48 is disposable upward through the rear connector aperture 58, the front frame 14 is pivotally connectable to the rear frame 18. Such pivotal movement, when freely permitted by a user, fosters the steerability of the system 10 while it is being rolled.

The frames 14, 18 can, however, be selectively locked against mutual rotation or pivotal movement. FIG. 3 through FIGS. 6A-B show that there is defined in a top surface of the front joining section 44 at least one front locking hole 63, which may be threaded to receive a locking screw or bolt 64. The locking flange 62 extends securely from the rear joining section 54 of the rear frame 18. Locking flange 62 is fully penetrated by at least one locking bolt hole 65, which also may be threaded for screwed engagement with the locking bolt 64. As indicated by FIGS. 3-4, when it is desired to prevent pivotal motion by either of the frames 14, 18, the rear frame 18 may be pivoted into a locking position relative to the front frame 14, in which the locking hole 63 and the locking bolt hole 65 are brought into vertical registration. With the locking hole 63 aligned with the locking bolt hole 65, the bottom of the locking flange 62 is placed against the top surface of the front joining section 44, and the locking bolt 64 is inserted (e.g., screwed) though the locking hole 63 and locking bolt hole 65. With the locking bolt 64 engaged through both holes 63, 65, the frames 14, 18 are prevented from pivotal movement relative to one another. Thus, means for releasably locking the rear frame 18 against pivotal movement relative to the front frame 14 include the locking flange 62, the locking holes 63, 65, and the locking bolt 64. A person skilled in the art recognizes that the bolt 64 alternatively could be an unthreaded pin or rod; other equivalent locking means are readily contemplated.

Figure 8:
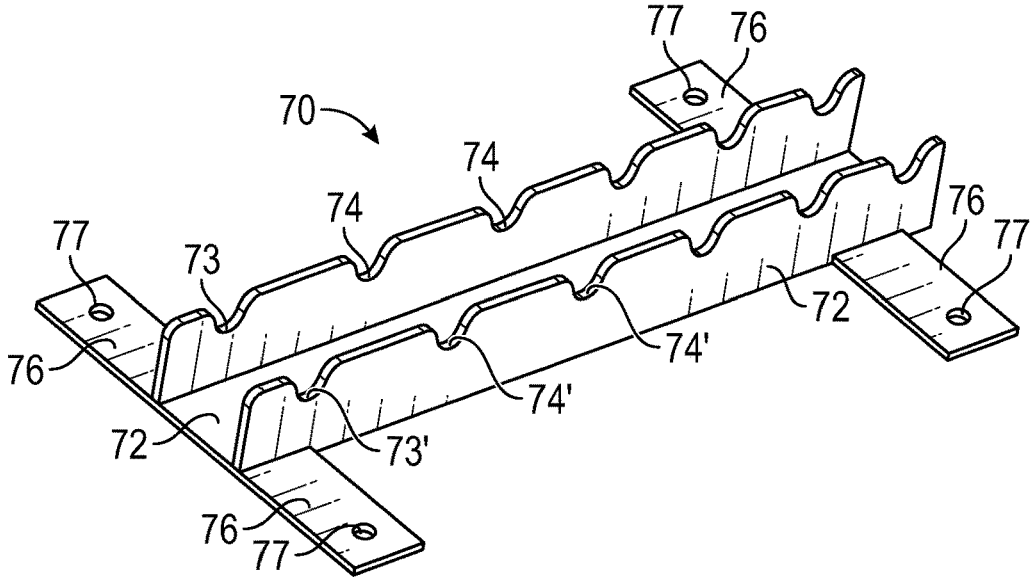
FIG. 8 is a perspective view of a dumbbell carrier that is temporarily mountable upon any of the front, intermediate, or rear frames of the system according to the invention.

The system includes auxiliary components for facilitating the storage of exercise equipment upon one or both the frames 14, 18. FIG. 8 depicts a dumbbell carrier 70 useable in the present invention. The dumbbell carrier 70 has a dumbbell rack 72 with at least two, and preferably a plurality, of upward facing notches therein. At least two notches 73, 73' are defined in the rack 72 with the notches 73, 73' aligned laterally to receive therein the central rod or grip portion of a dumbbell. One or more additional pairs of notches 74, 74' preferably are provided in the top of the rack 72, in parallel relation to the first pair of notches 73, 73', to accept and hold additional dumbbells. The dumbbell carrier 70 includes two or more, preferably four, mounting flanges 76 on or extending outward from the rack 72. Each mounting flange 75 is completely penetrated by at least one carrier mounting hole 77. The flanges 75 and carrier mounting holes are useable for mounting the dumbbell rack 70 on the top of either one, or both, of the frames 14, 18. To removably and adjustably mount the dumbbell carrier 70 to a frame 14, 18, the mounting holes 77 of the carrier are simply aligned with any of the top attachment apertures 46, 56, and pins, screws, bolts or rods (not shown) inserted through respective aligned holes temporarily to position and secure the carrier 70 to a frame.

Accordingly, having combined reference to FIGS. 3 and 8, it is seen that the dumbbell carrier 70 can be placed upon either, or both, of the frames 14, 18 with the carrier flanges 75 upon the tops of corresponding ones of the front arms 42, 42' and/or rear arms 52, 52'. Further, the dumbbell rack 72, and its flanges 75 and mounting holes 77, are configured so that at least two, preferably four, carrier mounting holes can be placed in registration with two (or four) associated top attachment apertures 46 (in front arms 42, 42') or with two (or four) top attachment apertures 56 (in the rear arms 52, 52'). With each carrier mounting hole 77 aligned with a top attachment aperture 46 or 56, screws, bolts, pins or other suitable attachment means may be inserted through the carrier mounting holes in the flanges 76 and into the top attachment apertures 46 or 56 to removably mount the carrier 70 to frame 14 or 18. In view of the foregoing, particular reference may be made to FIG. 1A, showing a dumbbell carrier 70 removably mounted on the horizontal rear arms 52 of the rear frame 18; a plurality of upward notches 73, 73', 74, 74' in the carrier 70 hold, in FIG. 1A, six dumbbells 15 in parallel. Referring to FIGS. 1 and 3, although not specifically illustrated, it is apparent to one skilled in the art that a second dumbbell carrier 70 likewise could be removably mountable on the horizontal front arms 42, 42' to similarly hold one or more dumbbells 15 in the manner of FIG. 1A, so that two dumbbell carriers 70 are deployed for use. Further, the system may be devised to permit two or more dumbbell carriers to be stacked vertically on either of the frames 14 and/or 18.

Figure 9:
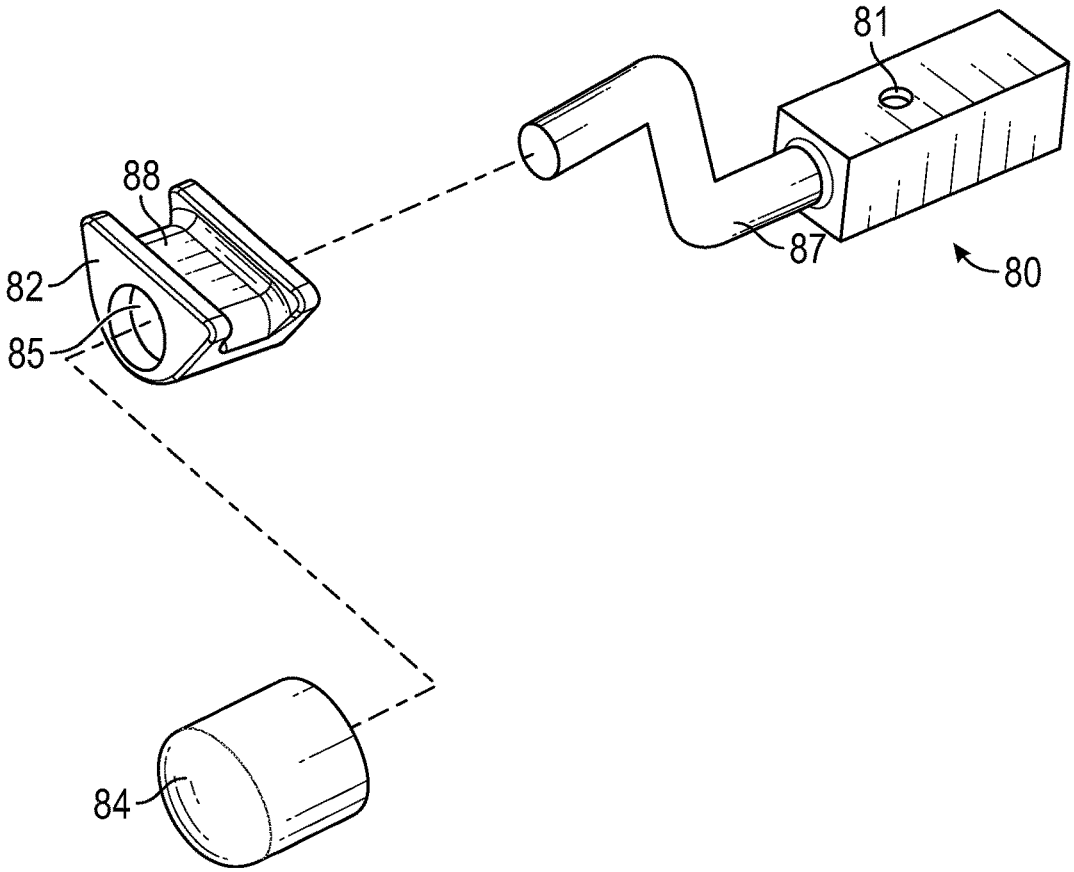
FIG. 9 is an exploded perspective view of a kettlebell carrier assembly useable in the system of the invention

FIG. 9 depicts an auxiliary assembly of the system 10 by which kettlebells 16 (FIG. 1A) may be transported and/or stored. There is provided according to the present invention at least one kettlebell carrier 80 with a kettlebell bracket 82, and a kettlebell carrier cap 84. As indicated in FIG. 1A, the assembly of a kettlebell carrier 80, kettlebell bracket 82, and a kettlebell carrier cap 84 is engageable with an open end 86 of any of the front arms 42, 42' (or the open end 86 of any of the rear arms 52, 52') of the respective frames 14 and 18. The kettlebell carrier 80 and kettlebell bracket 82 are composed from any rigid durable material, and may be plastic or metal, while the kettlebell carrier cap 84 preferably is fabricated to be resiliently elastic, as out of a flexible rubber or polymer. The base of the kettlebell carrier 80 has at least one pin hole 81 defined therein, as in its upper or top surface. A kettlebell carrier rod 87 extends (e.g., axially) from the main base of the carrier 80. As seen in the drawing figures, the kettlebell carrier rod 87 may define therein a pair of angles (e.g., two 90-degree angles) so to elevate an upper segment of the rod a sufficient height above the supporting surface 11 to provide vertical clearance for the carriage of a kettlebell above the supporting surface. There is defined horizontally, axially, through the kettlebell bracket 88 a kettlebell bracket mounting hole 85.

As suggested by FIG. 9, the kettlebell bracket 82 is slidably but reasonably snuggly engageable on and around the kettlebell carrier rod 87. The carrier rod 87 preferably is configured with two perpendicular bends therein, so to define a lower segment, a vertical segment, and an upper segment. Such a configuration provides that, when the kettlebell carrier 80 is engaged with an open end of any of the front arms 42, 42' or of the rear arms 52, 52', the upper segment is spaced a sufficient distance from the floor or other supporting surface to permit the largest of kettlebells 16 to be suspended above the supporting surface. With the kettlebell bracket 82 fully disposed along upon the kettlebell carrier rod 87 (e.g., the upper segment of the carrier rod), the kettlebell carrier cap 84, which has a flexibly adaptable socket (not shown) on one side, is securely but removably engaged upon the distal or "free" end of the kettlebell carrier rod 87, thereby to hold the bracket 82 against inadvertent detachment from the carrier rod. Each kettlebell bracket 82 has a groove or channel 88 defined in its top, adapted to receive the underside of a handle of a typical kettlebell (FIG. 1A).

Referring now, for example, to FIG. 5A, a free end (opposite the front joining section 44) of at least one of the front arms 42, 42' defines a receptacle opening 86 therein. Although not shown in FIG. 6A, a free end (opposite the rear joining section 52) of at least one of the rear arms 52, 52' likewise defines a receptacle opening 86 therein. The exterior dimensions and contours of the base of the kettlebell carrier 80 are complementary to the interior dimensions and contours of any receptacle opening 86.

Combined attention is returned to FIG. 1 and FIG. 4. A kettlebell carrier 80 accordingly is removably insertable horizontally into a receptacle opening 86 in any one or more of the ends of the arms 42, 42', or 52, 52' of the frames 14 and/or 18, with its kettlebell carrier rod 87 distending outward from the associated frame arm. The kettlebell bracket 82 is slidably engaged on the kettlebell carrier rod 87, and the bracket is adapted for receiving a kettlebell 16 thereupon (as seen in FIG. 1). The installed base of the kettlebell carrier 80 projects into the interior of the corresponding receptacle opening 86. As seen in FIG. 1A, a screw, pin, bolt or rod preferably may be temporarily inserted through a selected top attachment aperture 46 or 56 and into the co-aligned the carrier pin hole 81 of the kettlebell carrier 80, thereby to removably secure the kettlebell carrier within the receptacle opening 86. Alternatively, an embodiment may be devised in which the kettlebell carrier 80 has its one or more carrier pin holes 81 defined in its side; in such an alternative, a screw, pin, bolt or rod preferably may be temporarily inserted through a selected side attachment aperture 47 or 57 and into the co-aligned the carrier pin hole 81 of the kettlebell carrier 80. It is immediately understood that in the system 10 more than one (i.e., up to four) assembly (two seen in FIG. 1A) for receiving a kettlebell 16 may be provided and deployed, one assembly for each of the receptacle openings 86 in each of the horizontal arms 42, 42', or 52, 52'.

Figure 11:
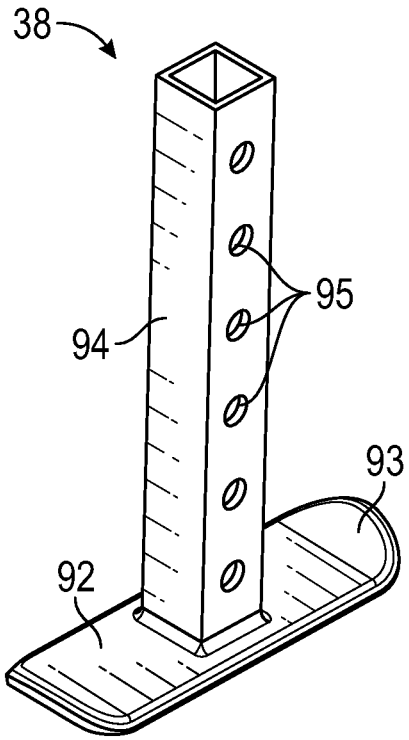
FIG. 11 is perspective view of a sled component optionally used in an alternative configuration of the system.

Attention is invited to FIGS. 2 and 11. A system according to the invention optionally includes the use of sled assemblies (including sleds and sled brackets) instead of weight plate wheels, to support and move the system across a supporting surface 11. As disclosed previously, an end of at least one of, preferably both, the front arms 42, 42' and/or an end of at least one, preferably both, the rear arms 52, 52' defines a receptacle opening 86. The system 10 optionally includes a sled brackets 39, 39' removably insertable horizontally into a corresponding receptacle opening 86, and sleds 38, 38' engageable with a corresponding sled bracket 39 or 39'. Sleds 38, 38' and sled brackets 39, 39' are composed of any rigid durable material, preferably metal alloy, and may include segments of tubular box girder. A single exemplary sled 38 is depicted by FIG. 11. A sled 38 according to the invention has a generally planar runner 92 with an optional shortly upturned front lip 93, a familiar configuration for ski tips and the runners of sleds and sleighs. Integral with, and extending vertically upward from, the runner 92 is the sled stanchion 94. The stanchion 94 has a series of vertically aligned pin holes 95 defined through its lateral sides.

A given sled 38 includes a vertical stanchion 94 slidably adjustable in, and relative to, the sled bracket 39, and a horizontal sled runner 92 at the bottom of the stanchion 94. Any one or more, preferably two or four, of the receptacle openings 86 in a system 10 may be used to receive and engage with a sled bracket 39 and its associated sled 38.

As suggested in FIG. 2, a sled bracket 39 has a horizontal portion whose exterior dimensions and contour are complimentary with the interior dimensions of a receptacle opening 86; accordingly the sled bracket horizontal portion is slidably, yet securely but removably, insertable into a receptacle opening 86 in a manner like that illustrated for the kettlebell carrier 80 in FIG. 4. The sled bracket's horizontal portion has at least one, preferably a plurality, of pin holes defined in and along its top. A screw, pin, or equivalent means preferably may be temporarily inserted through a selected top attachment aperture 46 or 56 and into a co-aligned the pin hole in the top of the sled bracket 39, thereby to removably secure the sled bracket within a receptacle opening 86. Alternatively, the bracket pin holes may be defined in the lateral sides of the brackets 39, 39', and a screw, pin, or equivalent temporarily inserted through a selected side attachment aperture 47 or 57 and into a co-aligned the pin hole in the side of the bracket to removably secure the sled bracket within a receptacle opening 86.

A sled bracket 39 also has a hollow vertical portion integrally connected thereto in perpendicular relation therewith. This hollow vertical portion has at least one, preferably a plurality, of vertically aligned pin holes defined through and along its sides. The exterior dimensions and contour of the sled stanchion 94 are complementary to the interior dimensions and shape of the hollow interior of the vertical portion of the sled bracket 39. Referring to both FIG. 2 and FIG. 11, the vertical sled stanchion 94 thus is slidably insertable/removable into/from the hollow vertical portion of the sled bracket 39. The position of the stanchion 94 within the hollow vertical portion of the sled bracket 39 consequently is selectively adjustable, as the stanchion can be moved manually up/down within the sled bracket 39 in a regulated manner. As suggested by FIG. 2, a screw, pin, rod, or the like may be temporarily inserted through a selected one of the pin holes in the side(s) of the vertical portion of the sled bracket 39 and into a co-aligned the pin hole 95 in the side(s) of the stanchion 94, thereby to temporarily secure the stanchion within the hollow vertical portion of the sled bracket 39. It is seen therefore, that the vertical location of a sled runner 92, relative to a frame 14 or 18, is adjustable by a user; this by the expedient of positioning the stanchion 94 at the desired elevation in the sled bracket 39, and choosing appropriately aligned ones of the pin holes, in the vertical portion of the sled bracket and the stanchion, through which to insert the locking screw, pin, or rod.

Referring to FIG. 2, it is apparent therefore that a sled assembly including a sled 38 and sled bracket 39, is optionally useable in lieu of a weight plate "wheel" (24, 26, 28, or 30) to support either or both of the frames 14, 18 upon the supporting surface 11. Sleds and sled brackets normally are used in pairs. In FIG. 2, for example, a pair of sleds 38, 38' and an associated pair of sled brackets 39, 39' are engaged in the receptacle openings 86 of a rear frame 18. With the elevations of the sleds 38, 38' properly (normally evenly and equally) adjusted within the sled brackets 39, 39' and temporarily secured therein, the second axle 34 and rear weight plate wheels 28, 30 could be removed from the rear frame 18. The rear frame 18 would then be supported by the sleds 38, 38', whose runners 92 then rest slidably upon the supporting surface 11.

The pulling tether 36, attached for example to the second axle 34, may then be used manually to pull the system 10 across the supporting surface. The increased friction between the supporting surface 11 and the sleds 38, 38' increases the manual force needed to move the system 10 across the supporting surface, thus increasing a "workout" by the user if desired. Although only two sleds 38, 38' and two sled brackets 39, 39' are seen in the drawing, it is readily understood that two additional sleds and associated sled brackets optionally could also be inserted and temporarily secured, if desired, in the respective receptacle openings 86 in the arms 42, 42' of the front frame 14 in FIG. 2. In such instance, both the frames 14 and 18 would be supported by sleds, and the system 10 could be moved only by sliding—rather than rolling—across the supporting surface, to provide a pulling exercise for a user.

A more extensive, alternative embodiment of the system 10 incorporates the use of the intermediate frame 22 (FIG. 1B) disposed between, and interconnected with, the front frame 14 and the rear frame 18. The inclusion of an intermediate frame increases the versatility of the system and its capacity to receive, hold, and store exercise equipment.

Figure 7A:
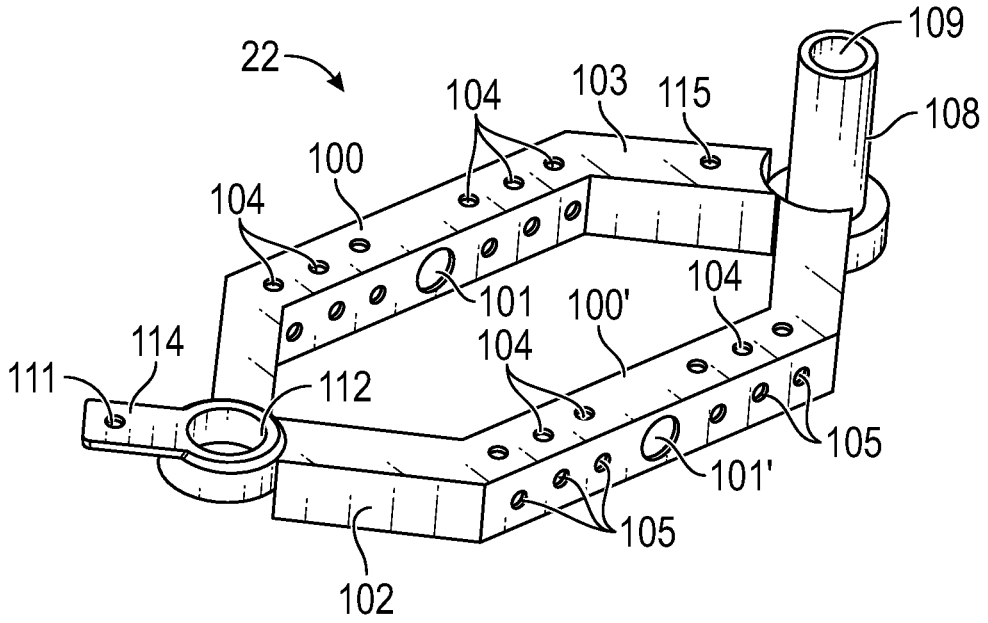
FIG. 7A is a perspective view of the intermediate frame component useable in the system according to the present invention.
Figure 7B:
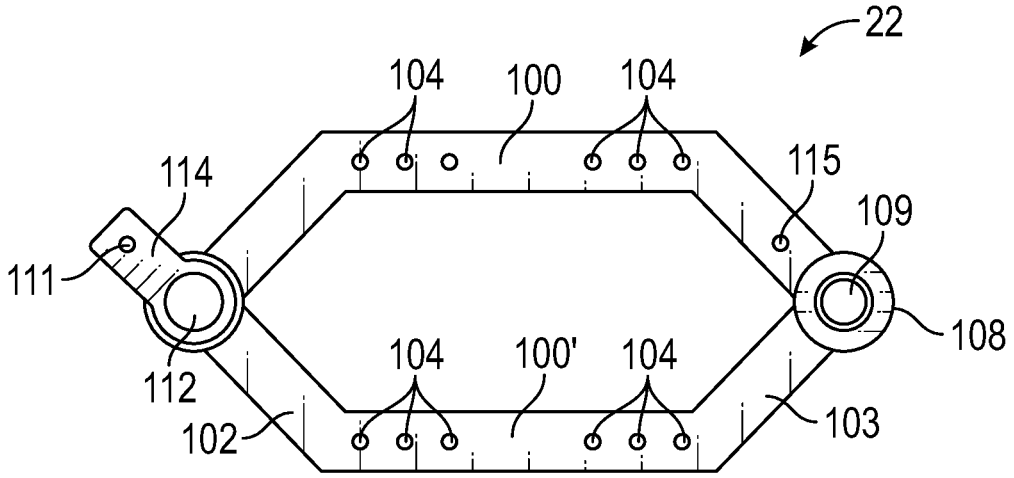
FIG. 7B is a top view of the intermediate frame seen in FIG. 7A.

The intermediate frame 22 seen in FIG. 1B is depicted in more detail by FIG. 7A and FIG. 7B. The intermediate frame 22 preferably is composed from a suitable strong, rigid material, such as a metal alloy. Like the other frames 14, 18, the intermediate frame 22 preferably is fabricated, as by welding of tubular square box girders, so that its intermediate arms 100, 100' and joining sections 102, 103 are permanently combined as a single monobloc. The intermediate frame 22 includes two parallel horizontal intermediate arms 100, 100', each penetrated by at least one intermediate axle hole 101, 101'. An anterior joining section 102 joins two ends of the intermediate arms 100, 100', and a posterior joining section 103 joins the other two ends of the intermediate arms.

Also like the other frames 14, 18, the intermediate arms 100, 100' have a plurality of middle top attachment apertures 104 defined serially along each of the intermediate arms, and vertically penetrating each arm. Similarly, the intermediate arms 100, 100' also have a plurality of middle side attachment apertures 105 defined serially along each of the intermediate arms, and laterally penetrating the sides of each arm. Also seen in FIGS. 7A and 7B is a second connector shaft 108 extending vertically upward from the posterior joining section 103. The second connector shaft 108 preferably is a tube defining a cylindrical hollow interior 109 with a closed bottom (i.e., the top of the second connector shaft interior 109 is open, but the interior is closed at or near the junction of the shaft 108 with the posterior joining section 103). The second connector shaft 108 is secured to or integral with the posterior joining section 103.

Also seen in FIGS. 7A and 7B is an intermediate connector aperture 112 extending vertically through the anterior joining section 102. The intermediate connector aperture 112 preferably is a tube defining a cylindrical hollow interior 113, and is secured to or integrally defined through the anterior joining section 102. The intermediate connector aperture 112 is engageable with the first connector shaft 48 on the first frame 14, so to connect the intermediate frame 22 to the front frame 14 in effectively the same manner as the rear connector aperture 58 is engageable with the first connector shaft 48 to connect together the front frame 14 and rear frame 18 as described hereinabove (FIGS. 3 and 4). Similarly, the second connector shaft 108 on the intermediate frame 22 is engageable with the rear connector aperture 58 on the rear frame 18 to connect the intermediate frame 22 to the rear frame 18 in effectively the same manner as the rear connector aperture 58 is engageable with the first connector shaft 48 to connect together the front frame 14 and rear frame 18. The extended embodiment of the system is understood, therefore, to include three serially interconnected frames, i.e., the intermediate frame 22 situated between the front frame 14 and the rear frame 18, as illustrated in FIG. 10.

Figure 10:
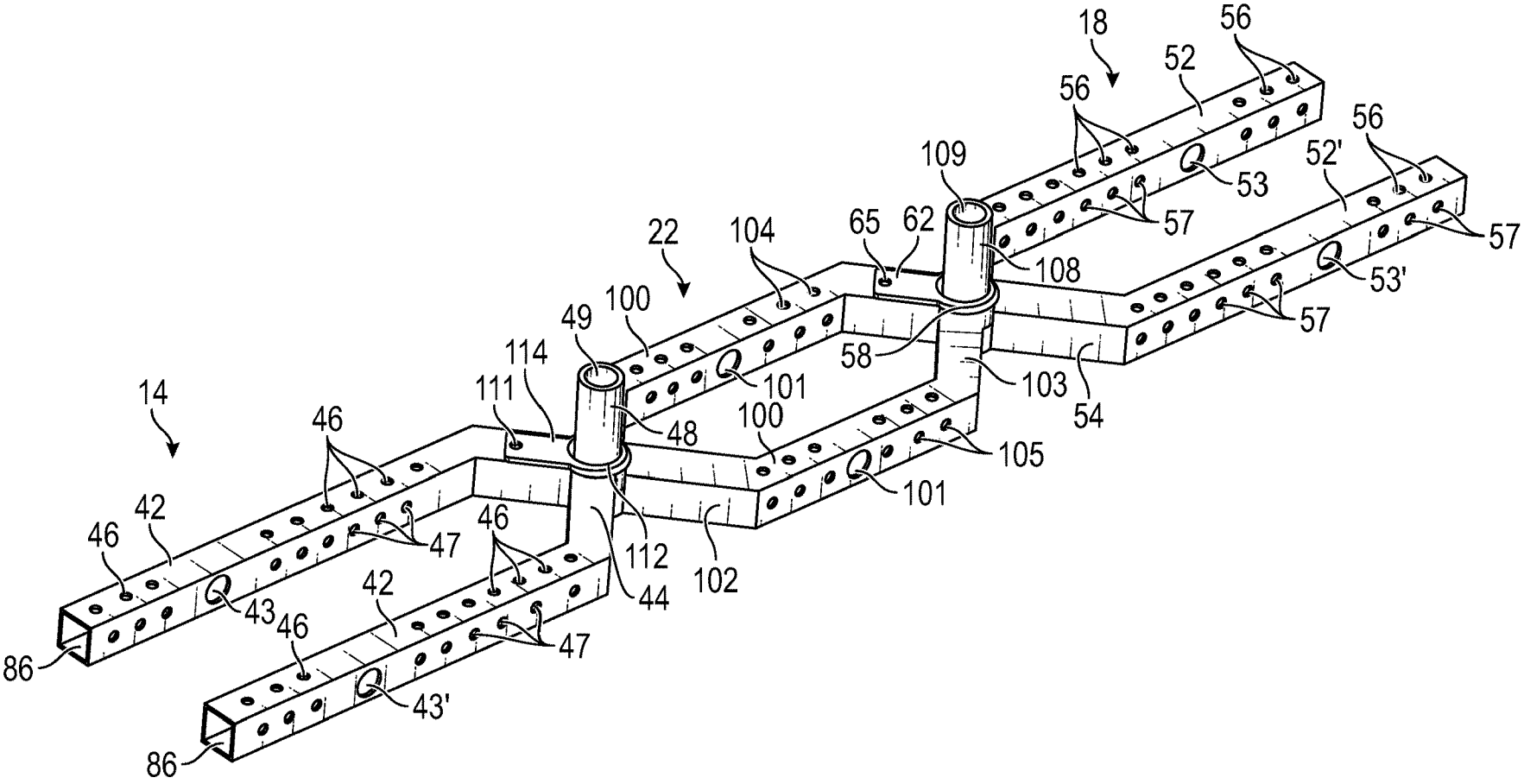
FIG. 10 is a perspective view of an extended alternative embodiment of the system, showing how the intermediate frame may be situated between, and interconnected with, the front frame and the rear frame.

Considering FIG. 10 in the context of the previous discussion of the operative connection between front frame 14 and rear frame 18 promotes a full understanding of the extended embodiment of the system 10. The second connector shaft 108 and the rear connector aperture 58 are operative engageable to serve as a means for connecting the intermediate frame's posterior joining section 103 to the rear joining section 54 of the rear frame 18. As the second connector shaft 108 extends vertically upward from the posterior joining section 103, and with the rear connector aperture 58 defined vertically through the rear joining section 54, the second connector shaft is disposable upward through the rear connector aperture, thereby to pivotally connect the rear frame 18 to the intermediate frame 22. When thus interconnected, the two frames 18, 22 are yoked together, yet pivotal relative to one another in the horizontal plane. However, the locking flange 62 extending from the rear joining section 54 adjacent the rear connector aperture 58, in combination with an intermediate locking hole 115 (FIGS. 7A-B) in the posterior joining section 103, permits the two frames 18, 22 to be selectively and temporarily locked against relative pivotal movement in the same mode and means as previously described herein (FIG. 4) respecting the front and rear frames 14, 18.

Similarly, the first connector shaft 48 and the intermediate connector aperture 112 are operative engageable to serve as a means for connecting the intermediate frame's anterior joining section 102 to the front joining section 44 of the front frame 14. As the first connector shaft 48 extends vertically upward from the front joining section 44, and with the intermediate connector aperture 112 extending vertically through the intermediate frame's anterior joining section 102, the first connector shaft is disposable upward through the intermediate connector aperture 112, thereby to pivotally connect the front frame 14 to the intermediate frame 22. When thus interconnected, the two frames 14, 22 are yoked together, yet pivotal relative to one another in the horizontal plane. But again, the intermediate locking flange 114 (with fastener hole 111 defined there-through) extending from the anterior joining section 102 adjacent the intermediate connector aperture 112, in combination with the locking hole 63 (FIGS. 5A-B) in the front joining section 44, permits the two frames 14, 22 to be selectively and temporarily locked against relative pivotal movement (as with a locking rod or bolt) in the same mode and means as previously described herein respecting the interconnection of the front and rear frames 14, 18. A user may selectively unlock the interconnection between any two frames ((14 and 22) and/or (22 and 18) to permit relative pivotal motion, thereby facilitating the steering of the entire system while it is being wheeled across a supporting system. When the system has arrived at a location (e.g., storage), the frames 14, 22, and 18 can be locked against swiveling motion.

The extended embodiment of the system 10 according to FIG. 10 otherwise is similar to, and functions similarly, to the basic system embodiment of FIGS. 1-3. The alternative extended embodiment according to FIG. 10 also is an exercise equipment storage and transport system for receiving at least two axles with at least one weight plate disposable on each end of each axle. It features the front frame 14 including two parallel horizontal front arms 42, 42', each penetrated laterally by one or more front axle holes 43, 43', and the front joining section 44 that joins the front arms. The alternative extended embodiment also features the rear frame 18 with two parallel horizontal rear arms 52 52', each penetrated laterally by one or more rear axle holes 53', 53', with the rear joining section 54 that joins the rear arms. But the extended embodiment also incorporates the intermediate frame 22 having its two parallel horizontal intermediate arms 100, 100', each penetrated by one or more intermediate axle holes 101, 101'. The intermediate frame 22 includes two joining sections at opposite ends thereof, namely the anterior joining section 102 that joins the intermediate arms and the posterior joining section 103 which also joins the intermediate arms.

The extended embodiment according to FIG. 10 includes means for connecting the front joining section 44 to the anterior joining section 102, and means for connecting the rear joining section 54 to the posterior joining section 103. As described above, the means for connecting the front joining section 44 of the first frame to the anterior joining section 102 of the intermediate frame includes the first connector shaft 48 extending vertically upward from the front joining section, and the intermediate connector aperture 112 extending vertically through the anterior joining section 102; the first connector shaft 48 is disposable upward through the intermediate connector aperture 112 to pivotally connect the front frame 14 to the intermediate frame 22.

The alternative embodiment of FIG. 10 also has means for connecting the rear joining section 54 of the rear frame 18 to the posterior joining section 103 of the intermediate frame 22. Such means for connecting includes the second connector shaft 108 extending vertically upward from the posterior joining section 103, and the rear connector aperture 58 extending vertically through the rear joining section 54; the second connector shaft 108 is disposable upward through the rear connector aperture to pivotally connect the intermediate frame to the rear frame.

It is readily apparent to a person of ordinary skill that the extended embodiment of the system, incorporating the three-part frames of FIG. 10, is used and functions quite similarly to the basic embodiment seen in, for example, FIG. 2. The extended embodiment is simply longer from front to back, with the front frame 14 connected to the intermediate frame 22, and the intermediate frame 22 connected to the rear frame 18. The connections initially are pivotal, but both connections can be releasably locked as described hereinabove to bar any frame against pivotal movement relative to an adjacent frame. Pivotal movement may be undesirable, for example, while the system 10 is being used solely to store equipment. Either or both connections between the respective frames 14, 18, 22 can, however, be unlocked so that two or all three frames can swing or pivot horizontally; such pivotal movement, which may be through, for example from zero to about 100 degrees about the pivotal axis, permits the direction of movement of the system 10 to be controllably steered while when the system is rolling/sliding across a supporting surface.

Considered in the context of the full disclosure herein, it is apparent that the intermediate frame 22 when included in the system functions and serves quite similarly to either of the front or rear frames 18. Referring to FIGS. 1B, 7A, 7B, and 8, it is apparent, for example, that a dumbbell carrier 70 may be releasably and adjustably mounted upon the top of the intermediate frame 22 by the means of pins, screws, or rods inserted through carrier mounting holes 77 co-aligned with respective ones of the middle top attachment apertures 104 in the intermediate frame. Accordingly, the extended alternative embodiment of the system option may mount one, two or three dumbbell carriers 70.

Figure 12:
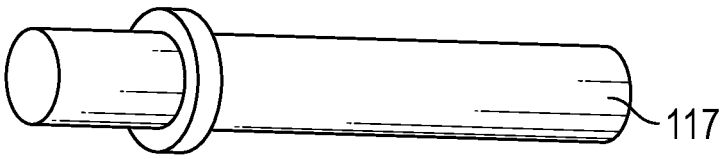
FIG. 12 is side view of a plate carrier rod optionally usable in the system according to the present invention.

A functional aspect unique to the extended embodiment of FIG. 10 is now described. Referring to both FIG. 1B and FIG. 12, one or two plate carrier rods 117 are provided for use in combination with the intermediate frame 22. Each plate carrier rod 117 may be inserted removably but securely into either or both the intermediate axle holes 101, 101' of the intermediate frame 22. (Temporary security may be provided by, for example a cotter pin (not shown) engaged through a hole (not shown) in the carrier rod 117, or by any other suitable equivalent means). With one or two plate carrier rods 117 disposed in the intermediate axle holes 101 and/or 101' one or more weight plates may be slidably and rotatably disposed onto the laterally extending carrier rod(s) (FIG. 1B) for transport and storage. Weight plates may be beneficially placed upon one or two a pair of carrier rods 117 in the intermediate frame 22 when, for example, sled assemblies (38, 38', 39, 39') are deployed for use in one or both of the other frames 14, 18. Further, it is apparent to one skilled in the art that, in lieu of one or two carrier rods 117, a single rod (e.g., axle 32 or 34) may be inserted through the intermediate axle holes 101, 101', and weight plates (e.g., 28, 30) rotatably disposed on opposite ends thereof, to provide an axle and wheels on the intermediate frame 22 in use on the extended alternative embodiment of the system 10. Such a deployment may be executed with either or both of the other frames 14, 18 also having wheeled support or sled-type support on the supporting surface.

Reference to FIG. 10 also discloses that the extended alternative embodiment of the system 10 permits one, or two, barbells to be vertically transported or stored on the system. A barbell may be removably into the interior 49 of the first connector shaft 48, and/or another barbell may be removable inserted into the interior 109 of the second connector shaft 108.

The overall system 10 also can be used to hold and store other equipment, including gloves and clothing, or the like, for example which may be hung upon the barbells 35. Further, pins or rods may be inserted into any ones of the top or side apertures 46, 47, 56, 57, 104, 105, and employed to hang or attach items to the system.

Although the invention has been described in detail with particular reference to these preferred embodiments, other embodiments can achieve the same results. In the previous description, specific details are set forth, such as specific materials, structures, dimensions, etc., in order to provide a thorough understanding of the present invention. However, as one having ordinary skill in the art would recognize, the present invention can be practiced without resorting to the details specifically set forth.

Only some embodiments of the invention and but a few examples of its versatility are described in the present disclosure. It is understood that the invention is capable of use in various other combinations and is capable of changes or modifications within the scope of the inventive concept as expressed herein. Modifications of the invention will be obvious to those skilled in the art and it is intended to cover in the appended claims all such modifications and equivalents.

I claim:

1. An exercise equipment storage and transport system for receiving two barbells, each barbell having two ends, with at least one weight plate disposable on each end of each barbell, and further comprising:

a front frame comprising:

two parallel horizontal front arms, each penetrated laterally by a front axle hole; and a front joining section that joins the two parallel horizontal front arms;

a rear frame comprising:

two parallel horizontal rear arms, each penetrated laterally by a rear axle hole; and a rear joining section that joins the two parallel horizontal rear arms; and means for connecting the front joining section to the rear joining section;

wherein a first axle comprising a first one of the two barbells is insertable through the front axle holes and a second axle comprising a second one of the two barbells is insertable through the rear axle holes.

2. The system according to claim 1, wherein when the first axle is inserted through the front axle holes, and when the second axle is inserted through the rear axle holes, at least two weight plates are disposable on each of the first and second axles with at least one weight plate on each end of each of the first and second axles to serve as a wheel upon which the frames may be rolled.

3. The system according to claim 2, further comprising a tether, releasably connected to one of the first and second axles, for manually pulling the system in rolled movement across a supporting surface.

4. The system according to claim 1, wherein the means for connecting comprises:

a first connector shaft extending vertically upward from the front joining section; and a rear connector aperture extending vertically through the rear joining section, wherein the first connector shaft is disposable upward through the rear connector aperture to pivotally connect the front frame to the rear frame.

5. The system according to claim 4 further comprising means for releasably locking the rear frame against pivotal movement relative to the front frame.

6. The system according to claim 4, wherein the first connector shaft is a hollow tube adapted to receive an end of one of the two barbells.

7. The system according to claim 1 further comprising a dumbbell carrier, removably mountable on the two parallel horizontal front arms or on the two parallel horizontal rear arms, defining therein a plurality of upward notches adapted for holding a dumbbell.

8. The system according to claim 1, wherein an end of at least one of the two parallel horizontal front arms or an end of at least one of the two parallel horizontal rear arms defines a receptacle opening therein, and the system further comprising:

a kettlebell carrier removably insertable horizontally into the receptacle opening; and a kettlebell bracket, engageable on the kettlebell carrier, adapted for receiving a kettlebell thereupon.

9. The system according to claim 1, wherein an end of at least one of the two parallel horizontal front arms or an end of at least one of the two parallel horizontal rear arms defines a receptacle opening therein, and the system further comprising:

a sled bracket removably insertable horizontally into the receptacle opening; and a sled engageable with the sled bracket and comprising:

a vertical stanchion slidably adjustable relative to the sled bracket; and a horizontal sled runner at a bottom of the vertical stanchion.

10. An exercise equipment storage and transport system for receiving two barbells, each barbell having two ends, with at least one weight plate disposable on each end of each barbell, and further comprising:

a front frame comprising:

two parallel horizontal front arms, each penetrated laterally by a front axle hole; and a front joining section that joins the two parallel horizontal front arms;

a rear frame comprising:

two parallel horizontal rear arms, each penetrated laterally by a rear axle hole; and a rear joining section that joins the two parallel horizontal rear arms; and an intermediate frame comprising:

two parallel horizontal intermediate arms, each penetrated by an intermediate axle hole;

an anterior joining section that joins the two parallel horizontal intermediate arms; and a posterior joining section that joins the intermediate arms;

means for connecting the front joining section to the anterior joining section; and means for connecting the rear joining section to the posterior joining section;

wherein a first axle comprising a first one of the two barbells is insertable through the front axle holes and a second axle comprising a second one of the two barbells is insertable through the rear axle holes.

11. The system according to claim 10, wherein when the first axle is inserted through the front axle holes, and when the second axle is inserted through the rear axle holes, at least two weight plates are disposed on each of the first and second axles, with at least one weight plate on each end of each of the first and second axles to serve as a wheel upon which the frames may be rolled.

12. The system according to claim 10, further comprising a carrier rod insertable into one of the intermediate axle holes to extend laterally outward from an end of one of the two barbells and upon which weight plates may be slidably engaged.

13. The system according to claim 10, wherein the means for connecting the front joining section to the anterior joining section comprises:

the first connector shaft extending vertically upward from the front joining section; and an intermediate connector aperture extending vertically through the anterior joining section, wherein the first connector shaft is disposable upward through the intermediate connector aperture to pivotally connect the front frame to the intermediate frame.

14. The system according to claim 13, wherein the means for connecting the rear joining section to the posterior joining section comprises:

a second connector shaft extending vertically upward from the posterior joining section; and a rear connector aperture extending vertically through the rear joining section, wherein the second connector shaft is disposable upward through the rear connector aperture to pivotally connect the intermediate frame to the rear frame.

15. The system according to claim 14 further comprising:

means for releasably locking the intermediate frame against pivotal movement relative to the front frame; and means for releasably locking the intermediate frame against pivotal movement relative to the rear frame.

16. The system according to claim 14, wherein the second connector shaft is a hollow tube adapted to receive an end of one of the two barbells.

17. The system according to claim 10 further comprising a dumbbell carrier, removably mountable on the two parallel horizontal front arms, or on the two parallel horizontal intermediate arms, or on the two parallel horizontal rear arms, defining therein a plurality of upward notches adapted for holding a dumbbell.

18. The system according to claim 10, wherein an end of at least one of the two parallel horizontal front arms or an end of at least one of the two parallel horizontal rear arms defines a receptacle opening therein, and the system further comprising:

a kettlebell carrier removably insertable horizontally into the receptacle opening; and a kettlebell bracket, engageable onto the kettlebell carrier, adapted for receiving a kettlebell thereupon.

19. The system according to claim 10, wherein an end of at least one of the two parallel horizontal front arms or an end of at least one of the two parallel horizontal rear arms defines a receptacle opening therein, and the system further comprising:

a sled bracket removably insertable horizontally into the receptacle opening; and a sled engageable with the sled bracket and comprising:

a vertical stanchion slidably adjustable relative to the sled bracket; and a horizontal sled runner at a bottom of the vertical stanchion.

* * * * *